US005511993A

United States Patent [19]

Yamada et al.

[11] Patent Number: 5,511,993

[45] Date of Patent: Apr. 30, 1996

[54] CONNECTOR SHIELD WIRE CONNECTION STRUCTURE

[75] Inventors: Satoshi Yamada; Mitsuhiro Matsumoto, both of Shizuoka, Japan

[73] Assignee: Yazaki Corporation, Tokyo, Japan

[21] Appl. No.: 296,189

[22] Filed: Aug. 25, 1994

[30] Foreign Application Priority Data

Aug. 25, 1993 [JP] Japan ..... 5-046253 U

[51] Int. Cl.[6] ..... H01R 13/658

[52] U.S. Cl. ..... 439/610

[58] Field of Search ..... 439/98, 610

[56] References Cited

U.S. PATENT DOCUMENTS

| | | | |
|---|---|---|---|
| 4,272,148 | 6/1981 | Knack, Jr. | 439/610 |
| 4,441,781 | 4/1984 | Forney, Jr. et al. | 439/584 |
| 4,789,355 | 12/1988 | Lee | 439/584 |
| 4,795,370 | 1/1989 | Freitag | 439/584 |

FOREIGN PATENT DOCUMENTS

| | | |
|---|---|---|
| 63-12174 | 1/1988 | Japan . |
| 386577 | 9/1991 | Japan . |
| 527975 | 4/1993 | Japan . |

*Primary Examiner*—Gary F. Paumen

*Attorney, Agent, or Firm*—Sughrue, Mion, Zinn, Macpeak & Seas

[57] ABSTRACT

A connector shield wire connection structure includes a connector housing including a shield wire accommodating portion, a conductive contact element including an inclined slide portion and a hold portion corresponding to a terminal shield portion of a shield wire, the conductive contact elements being connectable to the shield portion of a connector.

19 Claims, 8 Drawing Sheets

CONNECTOR SHIELD WIRE CONNECTION STRUCTURE

BACKGROUND OF THE INVENTION

1. Field of the Invention

The present invention relates to a connector shield wire connection structure which is capable of connecting the terminal shield portion of a shield wire to a connector shield portion simply and positively simultaneously when a shield cover of a connector housing is mounted or by means of the pushing operation of a pair of conductive contact elements.

2. Related Art

FIG. 12 shows a conventional connector shield wire connection structure disclosed in Japanese Utility Model Publication Sho No. 63-12174.

In the conventional structure, upper and lower shield metal covers 42, 43 are disposed on a connector main body 41 to thereby cover wires 44 provided within the connector main body 41, and the base portions 45, 46 of the two shield metal covers 42, 43 are contacted with the terminal shield portion 48 of a shield wire 47 and are also fastened and connected together with screws 49.

However, in the above-mentioned conventional structure, since the upper and lower shield metal covers 42, 43 are connected to each other with the screws 49 for contact with the terminal shield portion 48 of the shield wire 47, if the screws 49 are loosened, then contact resistance is increased to get the two metal covers 42, 43 into imperfect conduction, which in turn worsens the shielding performance of the structure. Also, the conventional structure requires a large man-hour.

SUMMARY OF THE INVENTION

It is an object of the invention to provide a connector shield wire connection structure which is capable of connecting the terminal shield portion of a shield wire to the shield portion of a connector main body simply and positively.

In attaining the above object, according to the invention, there is provided a connector shield wire connection structure which basically comprises: a shield wire terminal storage part of a connector housing including a pair of mutually opposing inclined walls; and, a pair of conductive contact elements to be connected to the shield portion of a connector, the conductive contact elements respectively including two inclined slide portions corresponding to the inclined walls of the shield wire terminal storage part, and hold portions corresponding to the terminal shield portion of a shield wire.

In particular, according to the invention, there is provided a first structure which comprises: a shield wire terminal storage part of a connector housing including a pair of mutually opposing inclined groove walls inclined along the peripheral direction of the shield wire; and, a pair of conductive contact elements including inclined slide portions corresponding to the inclined groove walls of the shield wire terminal storage part, shield wire terminal hold portions respectively bent formed from the inclined slide portions and capable of pressing the upper edge flange portions thereof against a shield cover disposed opposed to the shield wire terminal storage part, and shield wire terminal placement portions respectively bent formed from the inclined slide portions on the base end side thereof. And, in the first structure, in one of the pair of inclined groove walls and the inclined slide portions of the pair of conductive contact elements, there are provided a plurality of positioning projections succeeding one after another in the inclined direction, and, in the other, there are formed guide groove holes corresponding to the positioning projections and also there are provided run-over engaging portions respectively situated in the middle portions of the guide groove holes. Also, according to the invention, there can be also provided a second structure which comprises: a shield wire terminal storage part of a connector housing including a pair of mutually opposing inclined walls inclined in the lead-out direction of a shield wire; and, a pair of conductive contact elements including narrow hold portions corresponding to the terminal shield portion of the shield wire in the leading end portions thereof, inclined slide portions corresponding to the above-mentioned inclined walls in the middle portions thereof, and pushing operation portions in the base end portions thereof.

In the first structure, with the shield wire terminal storage part put on the shield wire terminal placement portions of the pair of conductive contact elements, the leading end portions of the shield wire terminal hold portions are pushed as the shield cover is closed and thus the inclined slide portions are slided down along the inclined groove walls of the shield wire terminal storage part. As a result of this, the pair of conductive contact elements are gradually narrowed in the wire holding direction so that the shield wire hold portions hold the shield wire terminal portion between them for connection.

And, in the first structure, if there are provided the succeeding, positioning projections, guide groove holds and run-over engaging portions, then the succeeding, positioning projections run over the guide groove holes while they are in engagement therewith as the conductive contact elements are slided down, and thus are engaged sequentially with the runover engaging portions to thereby match the positions of the pair of conductive contact elements to each other, so that the smooth slide operation and the positive holding and connection can be realized.

Also, in the second structure, by pushing a pair of conductive contact elements in the longitudinal direction of the shield wire in the shield wire terminal storage part of a connector housing, the inclined slide portions of the conductive contact elements are slided along the inclined walls of the wire terminal storage part and thus the hold portions of the conductive contact elements are moved in the width narrowing direction to thereby be able to hold the wire terminal portion between them.

DETAILED DESCRIPTION OF THE PREFERRED EMBODIMENTS

In FIGS. 1 to 6, there is shown a first embodiment of a connector shield wire connection structure according to the invention.

Figure 1:
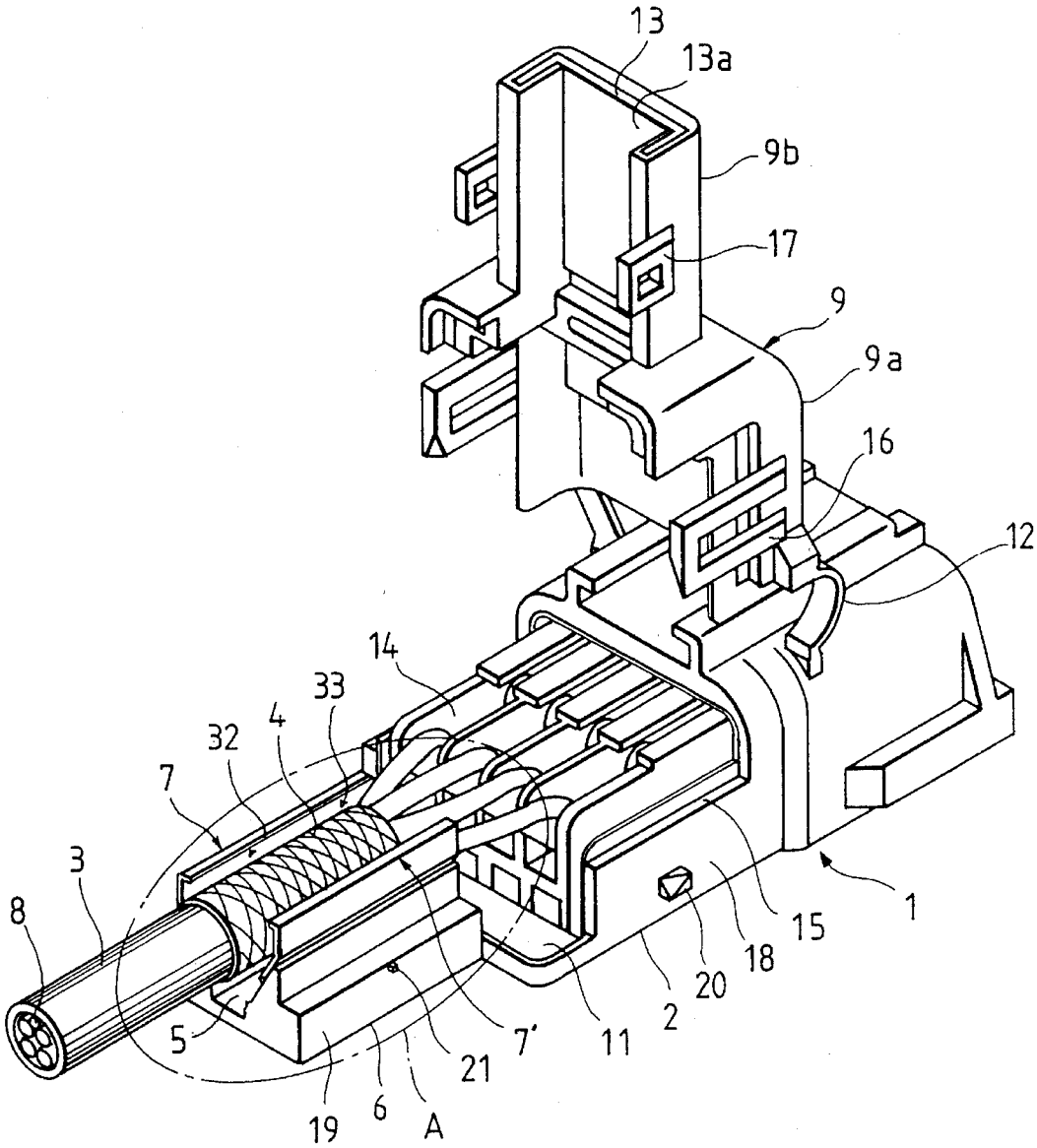
FIG. 1 is a general perspective view of a first embodiment of a connector shield wire connection structure according to the invention.
Figure 2:
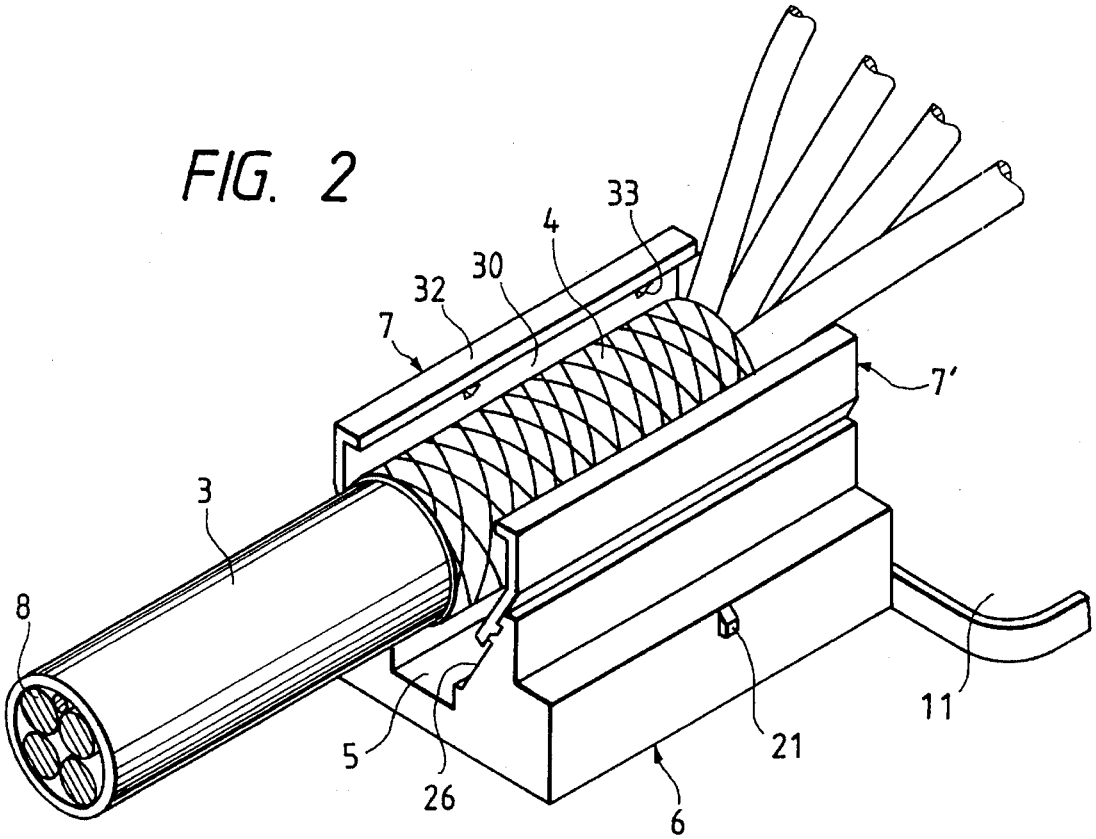
FIG. 2 is an enlarged perspective view of an A portion shown in FIG. 1.

In the present structure, as shown in FIGS. 1 and 2, a shield wire terminal storage part 6 having a V-shaped groove 5 capable of storing a terminal shield portion (knitted portion or shield tape portion) 4 of a shield wire 3 is formed integrally in the rear end portion of an insulation housing 2 of a shield connector main body 1, a pair of conductive contact elements 7, 7' each formed of a conductive plate of iron, aluminium, copper or the like are slidably provided on the V-shaped groove 5, the terminal shield portion 4 of the shield wire 3 is interposed between the pair of conductive contact elements 7, 7', and a rear shield cover 9 is closed with respect to the connector main body 1 to thereby press down the pair of conductive contact elements 7, 7' along the inclined groove walls 10, 10 (see FIG. 4) of the V-shaped groove 5, whereby the terminal shield portion 4 is held by and between the pair of conductive contact elements 7, 7'.

A metal shield 11 is provided in the connector housing 2, a metal shield 13 is provided in the rear shield cover 9 which is mounted on the connector housing 2 through a hinge 12 in such a manner that it can be opened and closed freely, and the top plate portion 13*a* of the metal shield 13 is exposed to the inside of the rear shield cover 9. The rear shield cover 9 includes a main body portion 9*a* corresponding to a rear opening 15 in communication with a terminal storage chamber 14 formed in the connector housing 2, and a secondary body portion 9*b* corresponding to the shield wire terminal storage part 6. To close the rear shield cover 9, lock frame pieces 16, 17 respectively provided in the main and secondary body portions 9*a*, 9*b* may be engaged with lock projections 20, 21 respectively provided in housing side walls 18 and terminal storage side walls 19.

Figure 3:
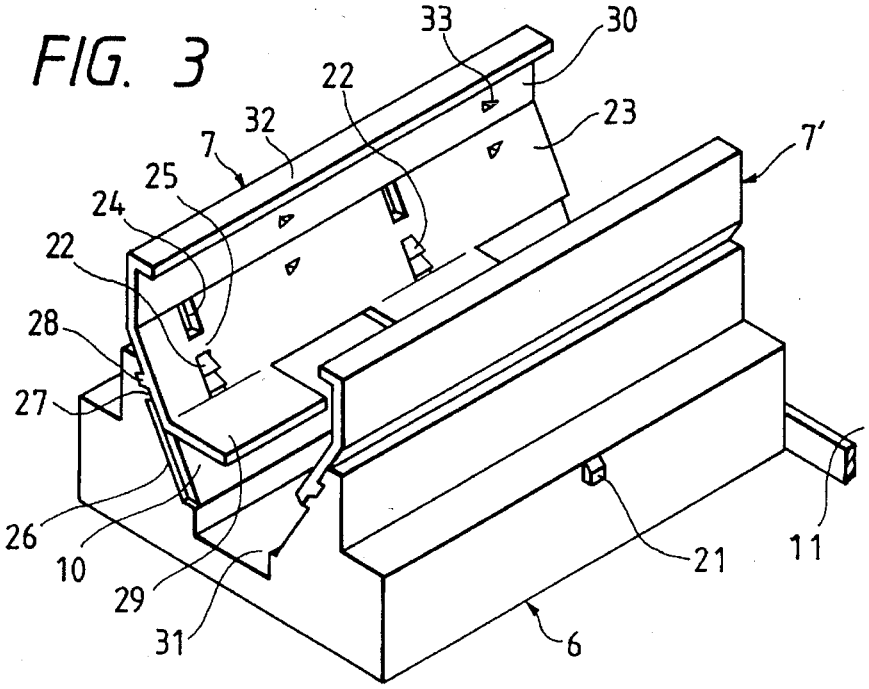
FIG. 3 is a perspective view of a shield wire terminal storage part and two conductive contact elements, showing the provisionally engaged state between them.
Figure 4:
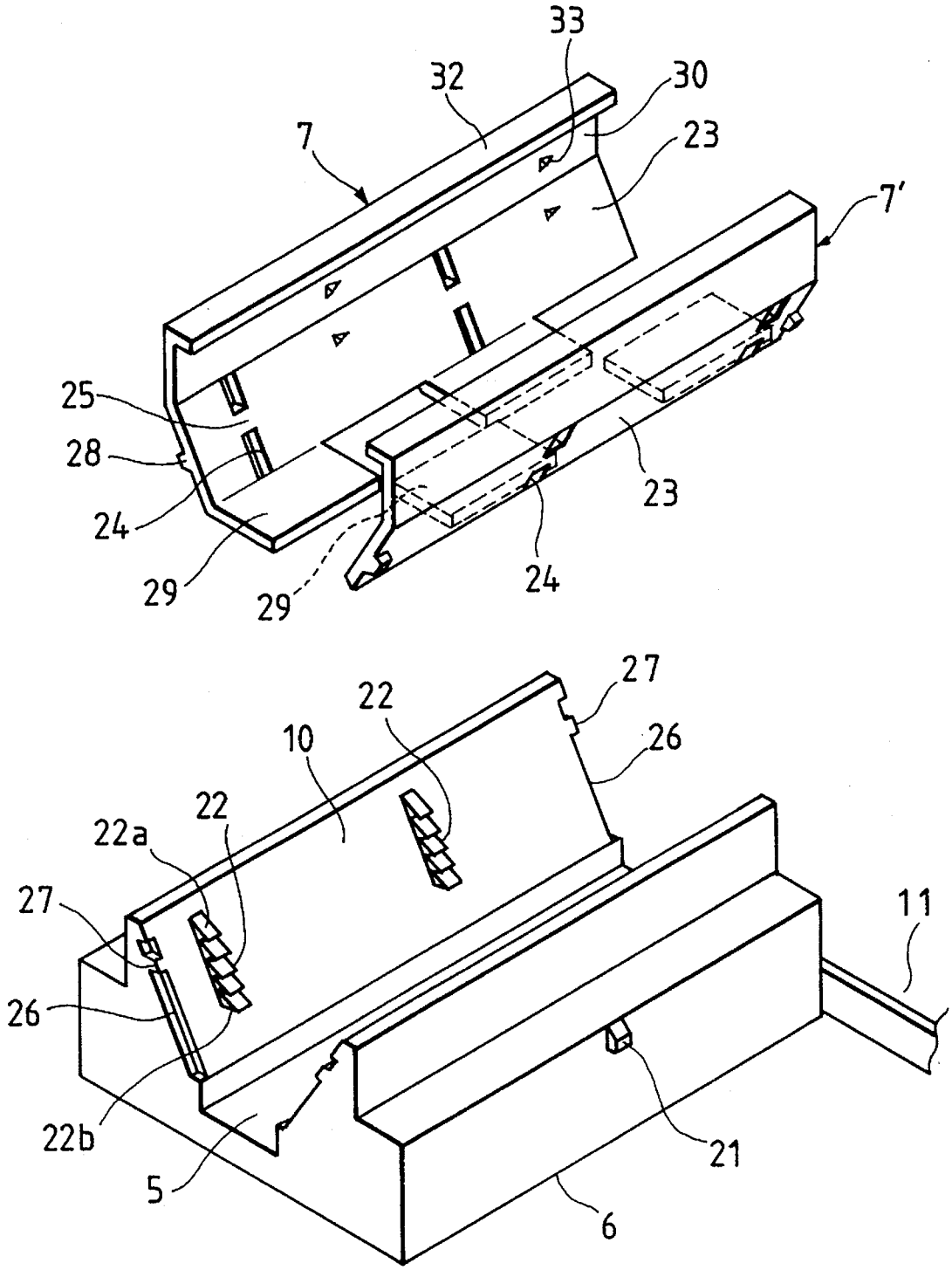
FIG. 4 is an exploded perspective view of the shield wire terminal storage part and two conductive contact elements, showing how the conductive contact elements are engaged with the shield wire terminal storage part.

As shown in FIGS. 3 and 4, in the front and rear portions of each of the pair of mutually opposed, inclined groove walls 10, 10 of the shield wire terminal storage part 6, there are provided a plurality of positioning projections 22 which succeed one after another in the inclined direction of the inclined groove walls 10, 10. On the other hand, in the slide portions 23, 23 of the pair of conductive contact elements 7, 7' corresponding to the pair of inclined groove walls 10, 10, there are opened up oblong guide groove holes 24 corresponding to the positioning projections 22 and also there are provided in the middle portions of the guide groove holes 24 run-over engaging portions 25 which are not opened up. Each of the succeeding positioning projections 22 is formed in a saw-tooth shape which includes an upwardly facing, inclined surface 22*a* and a downwardly facing, substantially horizontal surface 22*b*. This structure permits the conductive contact elements 7, 7' to slide only in a downward direction. When the conductive contact elements 7, 7' slide down, the positioning projections 22 are engaged with the run-over engaging portions 25 sequentially to thereby be able to match the positions of the pair of conductive contact elements 7, 7' to each other.

Also, as shown in FIG. 4, in the front and rear ends of each of the pair of inclined groove walls 10, 10, there are formed guide grooves 26, 26 extending in the inclined direction of the inclined groove walls and also there are provided securing projections 27 in the upper portions of the guide grooves 26. On the other hand, in the height-direction middle portions of the outer surfaces of the slide portions 23 of the pair of conductive contact elements 7, 7', there are provided provisionally engaging projections 28 which correspond to the guide grooves 26 and securing projections 27. As shown in FIG. 3, the provisionally engaging projections 28 allow the conductive contact elements 7, 7' to be secured provisionally in the upper portions of the inclined groove walls 10, 10 and also allow the upper half sections of the conductive contact elements 7, 7' to project upwardly from the shield wire terminal storage part 6. In this state, the positioning projections 22 are situated in the lower portion of the runover engaging portions 25.

Each of the conductive contact elements 7, 7' includes the slide portion 23, a shield wire terminal placement portion 29 projecting inwardly and horizontally from the base end of the slide portion 23, a shield wire terminal hold portion 30 which is bent from the upper edge of the slide portion 23 in an inwardly dog-legged manner and extends vertically.

The shield wire terminal placement portions 29 are projectingly provided alternately in the pair of conductive contact elements 7, 7' and the projection length of the shield wire terminal placement portion 29 is set smaller than the width of a groove bottom portion 31 formed in the shield wire terminal storage part 6. Also, the upper edge portion of the shield wire terminal hold portion 30 is bent inwardly at right angles to form a flange portion 32 which is to be pressed against the metal shield exposed portion (top plate portion) 13*a* of the rear shield cover 9. In the upper inside surface of the slide portion 23 and in the middle inside surface of the shield wire terminal hold portion 30, there are formed insertion projections 33 by embossing or the like which are to be inserted into the shield wire terminal portion 4, so that the shield wire terminal portion 4 can be contacted and held further positively.

Figure 5:
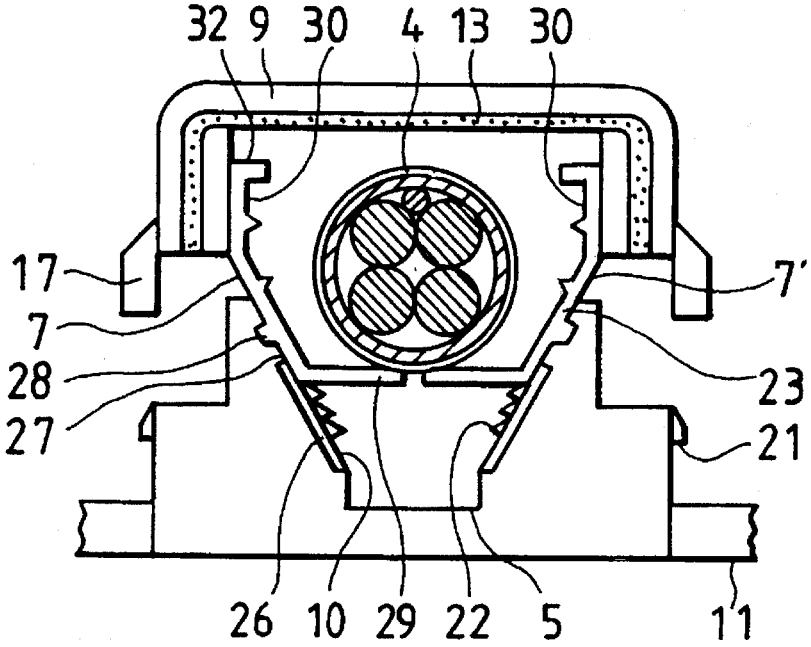
FIG. 5 is a front view of a shield wire terminal storage part and a rear shield cover, showing how the rear shield cover is closed with respect to the storage part.
Figure 6:
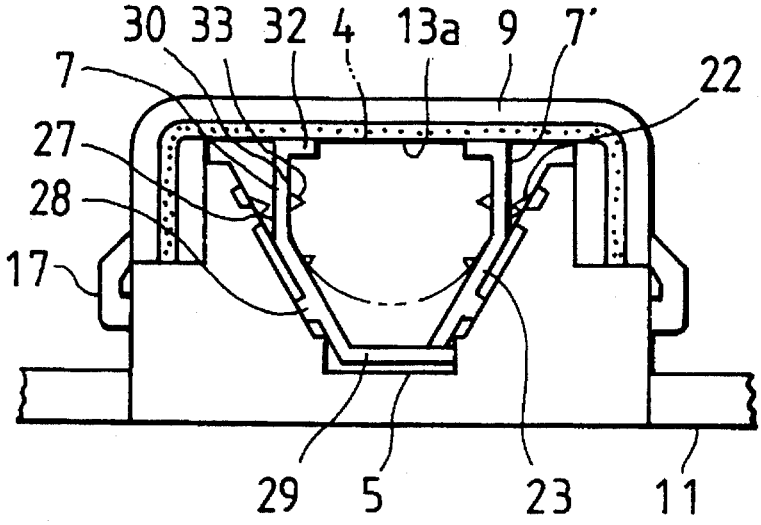
FIG. 6 is a front view similar to FIG. 5, showing how the rear shield cover is closed and a shield wire terminal portion is held between and connected with a pair of conductive contact elements.

And, as shown in FIGS. 5 and 6, in the provisionally secured state of the conductive contact elements 7, 7', the shield wire terminal portion 4 is put on the placement portion 29 and the rear shield cover 9 is closed with respect to the shield wire terminal storage part 6. With the closing operation of the rear shield cover 9, the upper edge flange portions 32 of the shield wire terminal hold portions 30 of the conductive contact elements 7, 7' are pushed downwardly, the slide portions 23 are slided down along the inclined groove walls 10, and the two conductive contact elements 7, 7' are moved inwardly, so that the shield wire terminal hold portions 30, 30 are surely be able to hold the shield wire terminal portion 4 between them.

The metal shield exposed portion 13*a* of the metal shield 13 is in contact with the upper edge flange portion 32 of the shield wire terminal hold portion 30 and the shield with terminal portion 4 to ground the metal shields 11, 13 through a drain line 8 (FIG. 2). Also, the engagement between the saw-tooth positioning projections 22 and run-over engaging portions 25 prevents the upward movements of the conductive contact elements 7, 7' and also the lock frame portions 16, 17 are engaged with the lock projections 20, 21 to thereby lock the rear shield cover 9.

Now, in FIGS. 7 to 11, there is shown a second embodiment of a connector shield wire connection structure according to the invention.

Figure 7:
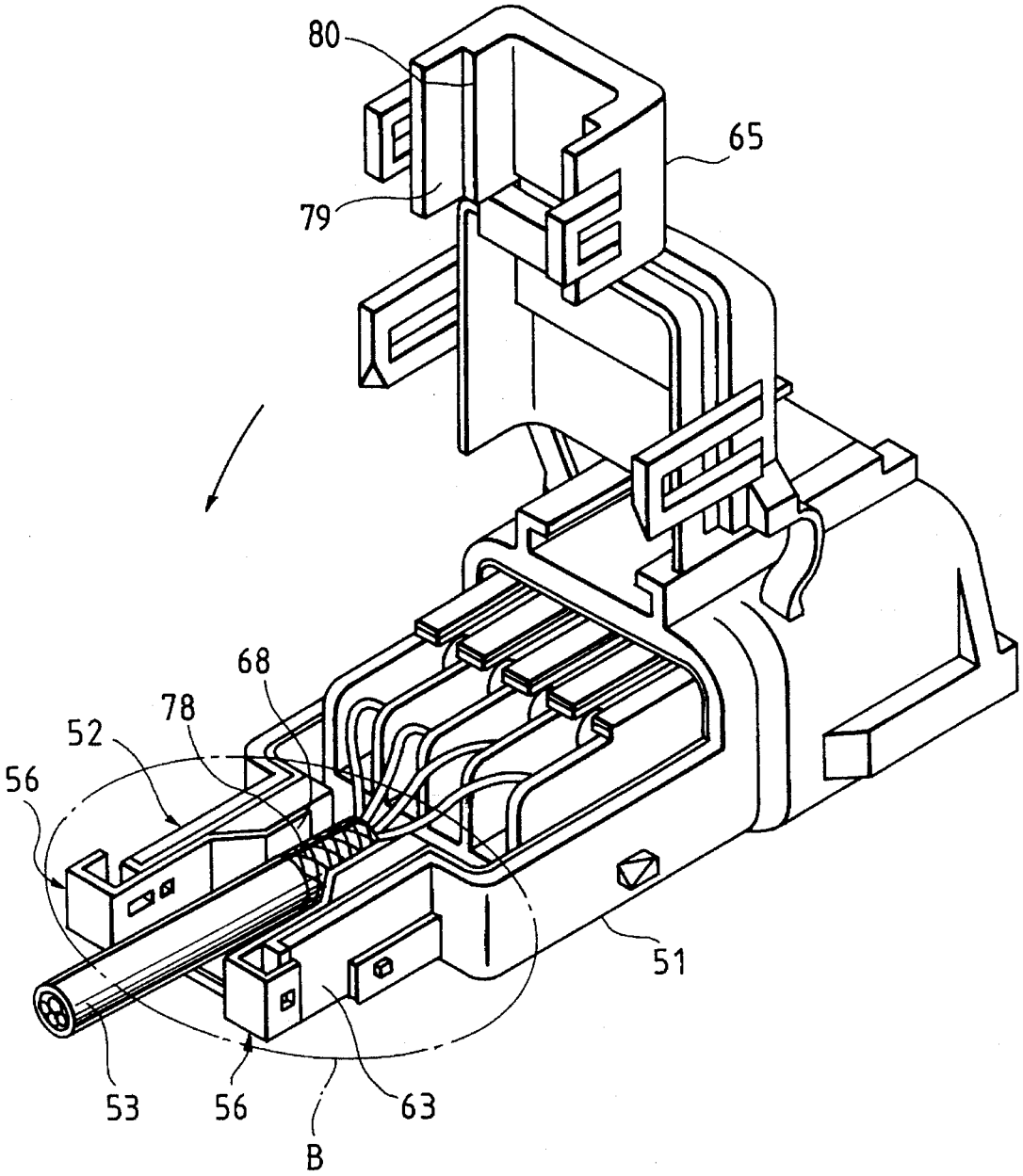
FIG. 7 is a general perspective view of a second embodiment of a connector shield wire connection structure according to the invention.
Figure 8:
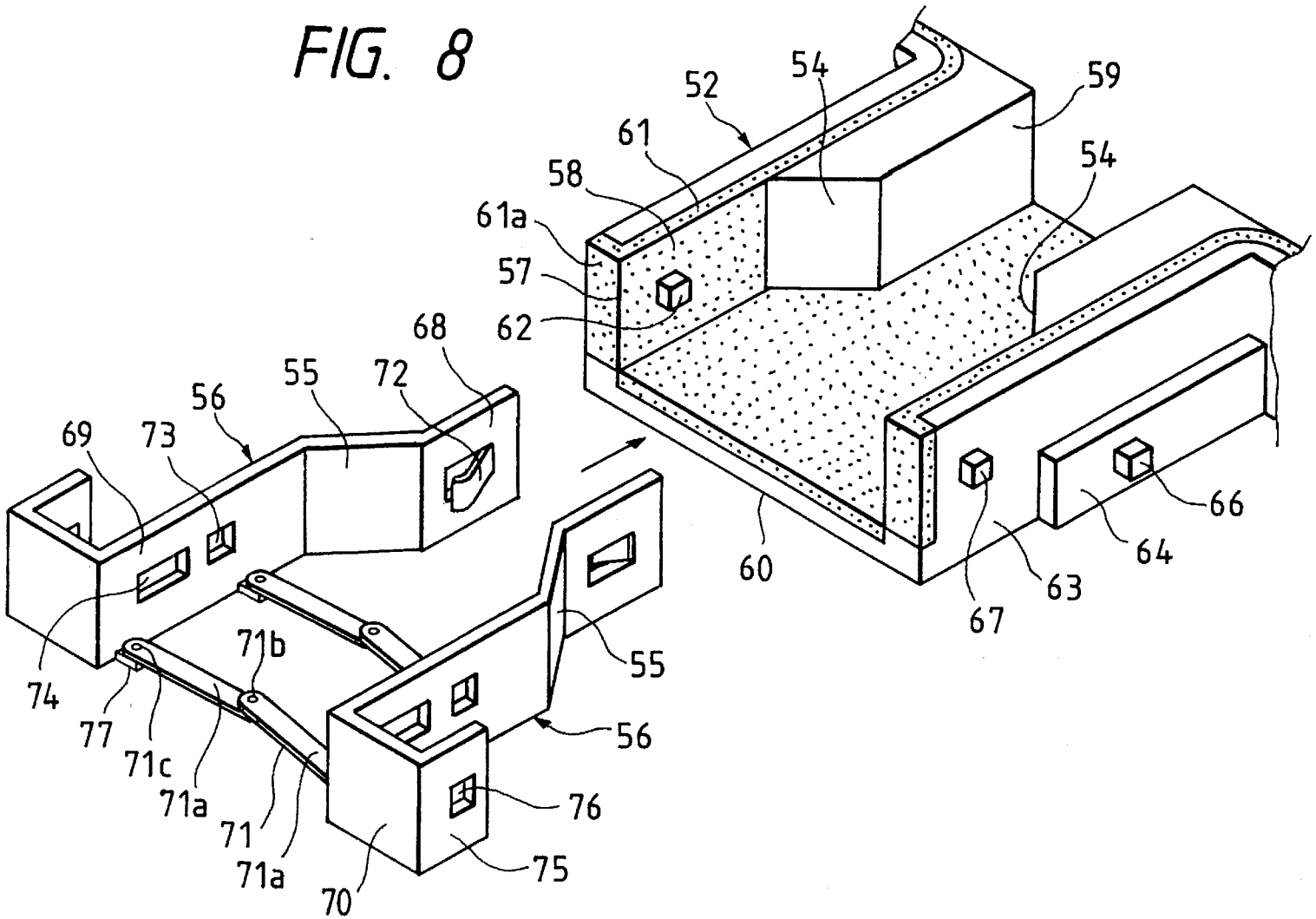
FIG. 8 is an enlarged and exploded perspective view of a B portion shown in FIG. 7.

According to this structure, as shown in FIGS. 7 and 8, in a shield wire terminal storage part 52 of a connector housing 51, there are formed a pair of inclined walls 54, 54 which respectively face the lead-out direction of a shield wire 53 and oppose to each other, and a pair of conductive contact elements 56, 56 each formed of metal and including an inclined slide portion 55 corresponding to the inclined wall 54 are inserted into the shield wire terminal storage part 52 from the leading end opening 57 side thereof.

The shield wire terminal storage part 52, as shown in FIG. 8, includes wide portions 58 continuing from the leading end opening 57, the above-mentioned inclined walls 54 continuing from the wide portions 58 and narrow portions 59 continuing from the inclined walls 54. The respective portions 58, 54, 59 are open at the ceiling sides thereof, respectively. A shield metal 61 is exposed onto the bottom wall 60 of the terminal storage part 52 and onto the inner walls of the wide portions 58, and the rear end folded portion 61*a* of the shield metal 61 is exposed onto the edges of the leading opening 57 as well. In the wide portions 58, there are provided provisionally securing projections 62 which respectively correspond to the conductive contact elements 56. Also, on the outer walls 63 of the terminal storage part 52, there are provided projection walls 64 and, on the projection walls 64, there are provided securing projections 66 which respectively correspond to a rear shield cover 65 (FIG. 7). In the rear end portions of the outer walls 63, there are provided actually securing projections 67 which respectively correspond to the conductive contact elements 56.

Each of the conductive contact elements 56, 56 is formed by bending a long, narrow strip of flat metal plate such that it includes in the leading end portion thereof a narrow hold portion 68 corresponding to the narrow portion 59 of the shield wire terminal storage part 52, in the middle portion thereof an inclined slide portion 55 corresponding to the inclined wall 54, in the base end portion thereof a wide and flat plate portion corresponding to the wide portion 58, and a pressure operation portion 70 bent in an L shape extending outwardly from the rear end of the flat plate portion 69. And, the lower end edges of the flat plate portions 69 are connected to each other by a bendable connecting hinge 71.

In the hold portion 68 of the conductive contact element 56, there is provided an elastic contact piece 72 by cutting and raising a portion of the hold portion 68, in the flat plate portion 69, there are formed a provisionally engaging hole 73 corresponding to the provisionally securing projection 62 on the inside of the terminal storage part 52 and an escape hole 74 located rearwardly of the provisionally engaging hole 73, and in the outer wall 75 of the L-shaped pressure operation portion 70 extending in parallel to the flat plate portion, there is formed an actually engaging hole 76 corresponding to the actually securing projection 67 of the terminal storage part 52. The connecting hinge 71 for connecting the conductive contact elements 56, 56 to each other is composed of a pair of flat rods 71*a*, 71*a* connected to each other by a central pin 71*b*, while the leading ends of the two flat rods 71*a* are connected to inner flanges 77 respectively projecting inwardly from the flat plate portions 69, so that the connecting hinge 71 can be bent in the horizontal direction. However, alternatively, instead of the connecting hinge 71, there can be employed a thin bendable hinge (not shown) which can be formed integrally with the conductive contact element 56.

Figure 9:
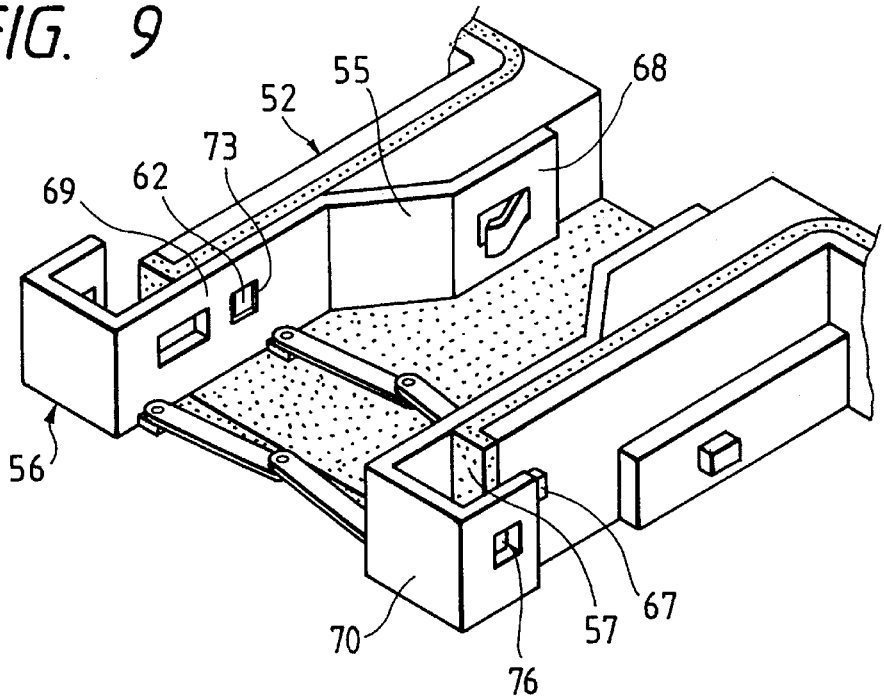
FIG. 9 is a perspective view of a shield wire terminal storage part and a pair of conductive contact elements, showing the provisionally engaged state between them.

The pair of conductive contact elements 56, 56, as shown in FIG. 9, are inserted into the shield wire terminal storage part 52 from the leading end opening 57 side thereof and are provisionally secured to the terminal storage part 52 with the provisionally securing projections 62 of the storage part 52 respectively engaged with the provisionally engaging holes 73 of the flat plate portions 69. In the provisionally secured state, the terminal portion 78 of the shield wire 53 is inserted between the pair of conductive contact elements 56, 56.

Figure 10:
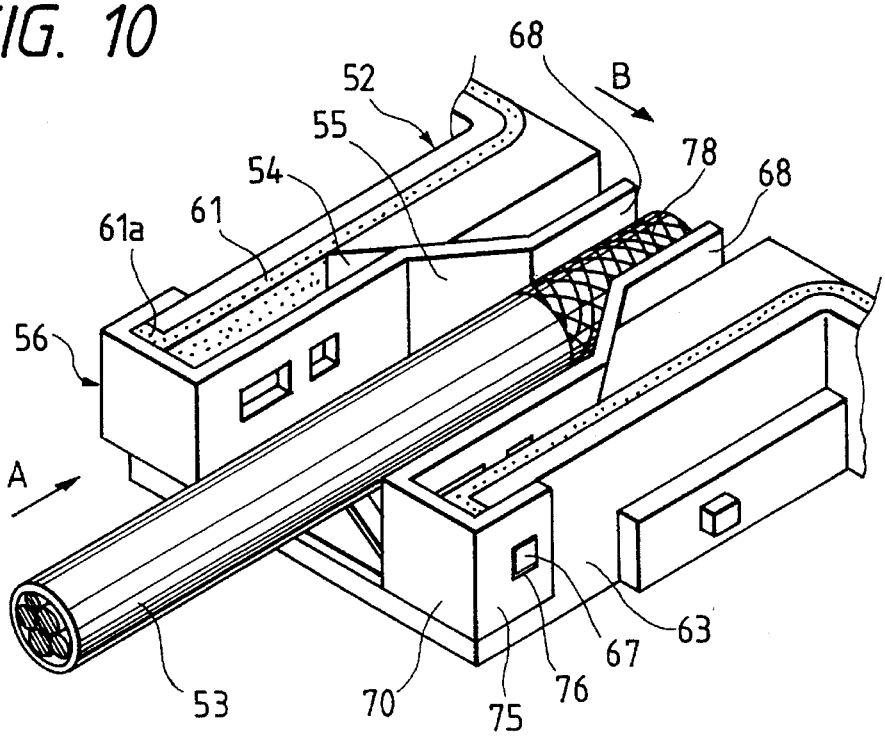
FIG. 10 is a perspective view of a shield wire terminal storage part, a pair of conductive contact elements and a shield wire, showing a state in which the conductive contact elements are actually engaged with the shield wire terminal storage part and the wire terminal portion is held between and connected with the conductive contact elements.

Next, as shown in FIG. 10, the pushing operation portions 70 of the conductive contact elements 56 are pushed in a wire insertion direction (that is, in a direction of an arrow (A)). Due to this pushing operation, the inclined slide portions 55 of the conductive contact elements 56 are slided along the inclined walls 54 of the terminal storage part 52, so that the conductive contact elements 56 are wholly moved in a width narrowing direction (that is, in a direction of an arrow (B). This causes the hold portions 68 of the conductive contact elements 56 to approach to each other to hold the terminal shield portion (the knitted portion) 78 of the shield wire 53 between them for shield connection of the shield wire 53 to the conductive contact elements 56 of the connector. At the same time, the pushing operation portions 70 are contacted with the rear end bent portions 61*a* of the shield metal 61 and further the actually engaging holes 86 in the outer walls 75 of the pushing operation portions 70 are engaged ( that is, actually engaged) with the actually securing projections 67 of the storage part outer walls 68, thereby preventing the conductive contact elements 56 from slipping off backwardly.

Figure 11:
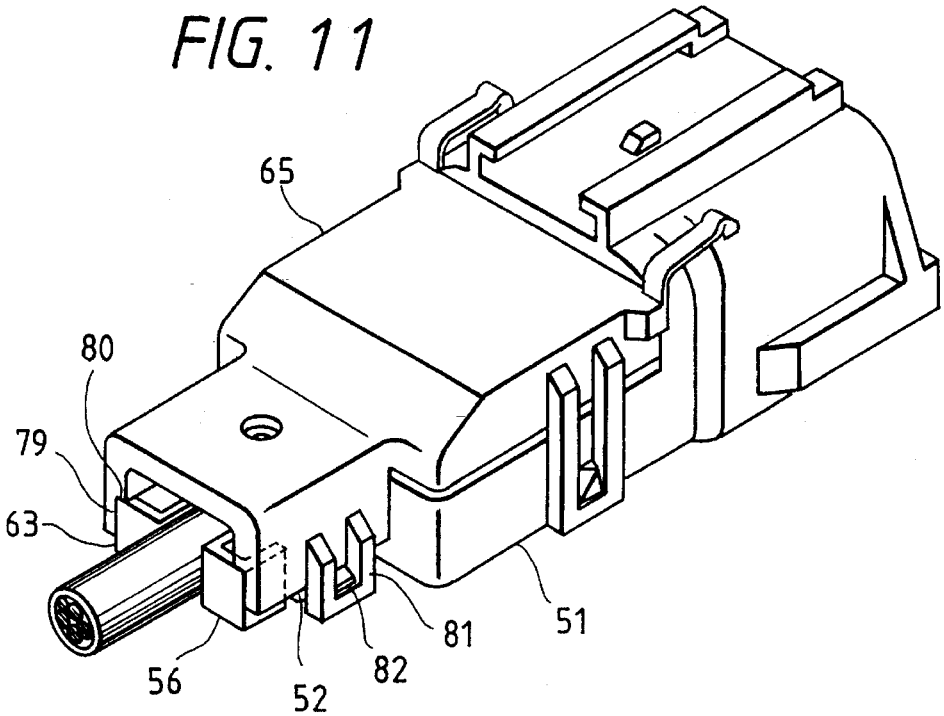
FIG. 11 is a perspective view of the connection structure with the rear shield cover closed.
Figure 12:
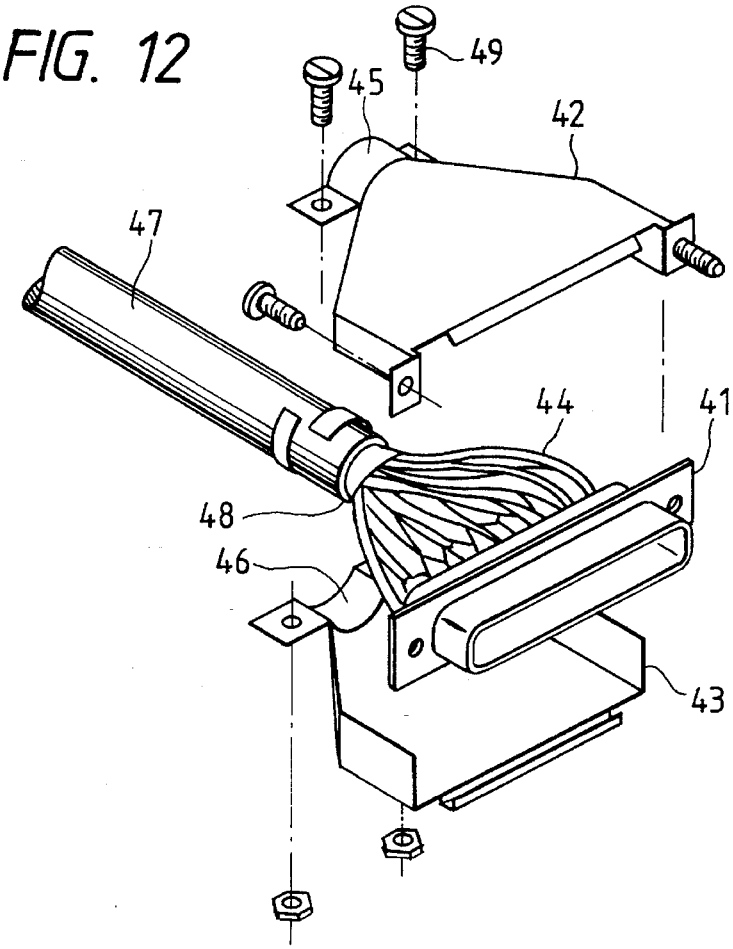
FIG. 12 is an exploded perspective view of a conventional connector shield wire connection structure.

Further, as shown in FIG. 11, by closing the rear shield cover 65, the inner walls 79 (FIG. 7) of the cover 65 are pressed against the outer walls 63 of the pushing operation portions 70 from the outside thereof to prevent the conductive contact elements 56 from moving (widening) in the width direction thereof, thereby securing contact pressure between the hold portions 68 and shield wire terminal portion 78. The inner walls 79 of the cover 65 each is formed in a stepped manner and the stepped portion 80 of the inner wall 79 contacts with and stops on the upper end of the terminal storage part 52 and, at the same time, the lock frame piece 81 of the cover 65 is engaged with the lock projection 82 of the connector housing 51.

As has been described heretofore, according to the invention, by means of the shield cover closing operation with respect to the connector housing and the pushing operation on the conductive contact elements in the shield wire insertion direction, a pair of conductive contact elements are slidingly moved in the inclined direction of the inclined wall and the shield wire terminal portion is firmly held between and connected with the pair of conductive contact elements, whereby the shield wire and connector can be connected to each other simply and positively.

Also, due to the engagement between the positioning projections and the run-over engaging portions, the positions of a pair of conductive contact elements can be matched to each other, which permits the smooth slide operations of the pair of conductive contact elements and further positive holding and connection thereof with respect to the shield wire terminal portion.

What is claimed is:

1. A connector shield wire connection structure comprising:

a connector housing including a shield wire accommodating portion and a shield cover for covering said shield wire accommodating portion;

a conductive contact element including a slide portion and a retaining portion for retaining a shield portion of a shield wire, wherein said shield wire accommodating portion has a pair of mutually opposing inclined groove walls and the conductive contact element includes an inclined slide portion corresponding to the inclined groove walls, a shield wire hold portion angled inwardly from the inclined slide portions and capable of pressing a distal end thereof against the shield cover opposed to the shield wire accommodating portion, and a shield wire placement portion angled inwardly from a base of the inclined slide portion for supporting the shield wire.

2. A connector shield wire connection structure as claimed in claim 1, wherein one of the inclined groove walls and the inclined slide portions has a positioning projection in an inclined direction and the other includes a guide groove hole corresponding to the positioning projection and run-over engaging portion positioned in the middle portion of the guide groove hole.

3. A shield wire connector, comprising:

a connector housing having an accommodating chamber therein;

a conductive contact element including opposing walls each including a clamping portion, said opposing walls defining a cavity therebetween in which a shield wire having a shield portion is receivable, said contact element being positioned in said accommodating chamber and being moveable in a predetermined direction from a provisional position at which said shield wire can be positioned in said cavity to a final position at which said shield portion of said shield wire is clamped by each said clamping portion of said opposing walls; and cam means for camming said opposing walls toward each other so as to clamp said shield portion in response to movement of said contact element from said provisional position to said final position, wherein said cam means comprises a pair of inclined side walls formed in said connector housing which partially define said accommodating chamber, said inclined side walls combining to form a v-shaped cam pointing in said predetermined direction, said opposing walls of said contact element being slidably provided on said inclined side walls.

4. The shield wire connector of claim 3, wherein said predetermined direction is in a direction perpendicular to the longitudinal axis of said shield wire.

5. The shield connector of claim 3, further comprising means for moving said contact element from said provisional position to said final position.

6. The shield connector of claim 5, further comprising a lid for covering said accommodating chamber of said connector housing.

7. The shield connector of claim 6, wherein closing of said lid forces said contact element to move in said predetermined direction to said final position.

8. The shield connector of claim 3, further comprising locking means for locking said contact element in said final position.

9. The shield connector of claim 8, wherein said locking means comprises a ratcheting mechanism.

10. The shield connector of claim 3, wherein said predetermined direction is in a direction perpendicular to the longitudinal axis of said shield wire.

11. The shield connector of claim 3, wherein said inclined side walls each has a plurality of projections and said opposing walls of said contact element each includes an engaging portion which is engaged by one of said plurality of projections, said projections preventing said contact element from moving in a direction opposite said predetermined direction.

12. The shield connector of claim 3, wherein said contact element includes two distinct elements each including one of said opposing walls, said distinct elements being interlocked with each other.

13. The shield connector of claim 3, wherein said predetermined direction is in a direction parallel to the longitudinal axis of said shield wire.

14. The shield connector of claim 3, wherein said side walls are interconnected by a linkage mechanism allowing said side walls to move toward and away from each other.

15. The shield connector of claim 14, further comprising a lid for covering said accommodating chamber and for preventing said side walls from moving away from each other when said contact element is in said final position.

16. A shield wire connector, comprising:

a connector housing having an accommodating chamber therein;

a conductive contact element including opposing walls each including a clamping portion, said opposing walls defining a cavity therebetween in which a shield wire having a shield portion is receivable, said contact element being positioned in said accommodating chamber and being moveable in a predetermined direction from a provisional position at which said shield wire can be positioned in said cavity to a final position at which said shield portion of said shield wire is clamped by each said clamping portion of said opposing walls;

cam means for camming said opposing walls toward each other so as to clamp said shield portion in response to movement of said contact element from said provisional position to said final position; and a lid for covering said accommodating chamber of said connector housing.

17. The shield connector of claim 16, wherein closing of said lid forces said contact element to move in said predetermined direction to said final position.

18. A shield wire connector, comprising:

a connector housing having an accommodating chamber therein;

a conductive contact element including opposing walls each including a clamping portion, said opposing walls defining a cavity therebetween in which a shield wire having a shield portion is receivable, said contact element being positioned in said accommodating chamber and being moveable in a predetermined direction from a provisional position at which said shield wire can be positioned in said cavity to a final position at which said shield portion of said shield wire is clamped by each said clamping portion of said opposing walls;

cam means for camming said opposing walls toward each other so as to clamp said shield portion in response to movement of said contact element from said provisional position to said final position; and locking means for locking said contact element in said final position, wherein said locking means comprises a ratcheting mechanism.

19. A shield wire connector, comprising:

a connector housing having an accommodating chamber therein;

a conductive contact element including opposing walls each including a clamping portion, said opposing walls defining a cavity therebetween in which a shield wire having a shield portion is receivable, said contact element being positioned in said accommodating chamber and being moveable in a predetermined direction from a provisional position at which said shield wire can be positioned in said cavity to a final position at which said shield portion of said shield wire is clamped by each said clamping portion of said opposing walls; and cam means for camming said opposing walls toward each other so as to clamp said shield portion in response to movement of said contact element from said provisional position to said final position, wherein said inclined side walls each has a plurality of projections and said opposing walls of said contact element each includes an engaging portion which is engaged by one of said plurality of projections, said projections preventing said contact element from moving in a direction opposite said predetermined direction.

* * * * *